US006158305A

United States Patent [19]

Slepicka

[11] Patent Number: 6,158,305

[45] Date of Patent: Dec. 12, 2000

[54] CAP REMOVER

[75] Inventor: Frank J. Slepicka, Berwyn, Ill.

[73] Assignee: Blackhawk Molding Co., Inc., Addison, Ill.

[21] Appl. No.: 09/175,719

[22] Filed: Oct. 20, 1998

[51] Int. Cl.[7] ..... B65B 7/16

[52] U.S. Cl. ..... 81/3.27; 81/3.25; 81/3.56

[58] Field of Search ..... 87/3.07, 3.25, 87/3.31, 3.27, 3.55, 3.56

[56] References Cited

U.S. PATENT DOCUMENTS

| | | | |
|---|---|---|---|
| 1,009,873 | 11/1911 | Webster | 81/3.27 |
| 1,975,472 | 10/1934 | Mosgrove et al. | 81/3.27 |
| 2,565,775 | 8/1951 | Mendenhall | 81/3.27 |
| 2,589,051 | 3/1952 | Carter | 81/3.56 |
| 2,599,462 | 6/1952 | Kowarsch | 81/3.27 |
| 2,757,561 | 8/1956 | Larner | 81/3.56 |
| 3,412,634 | 11/1968 | Lucarelli | 81/3.27 |

*Primary Examiner*—David A. Scherbel
*Assistant Examiner*—Joni B. Danganan
*Attorney, Agent, or Firm*—Baker & McKenzie

[57] ABSTRACT

A bottle cap remover used to separate a cap from a bottle wherein the cap has an upper section and a lower section, and at least a portion of the upper section of the cap protrudes radially outwardly beyond the lower section of the cap. The cap remover includes a first grip member and a second grip member. The first grip member is rigidly mounted to a stop plate in a position where the first grip member is spaced from the stop plate to define a gap between the first grip member and the stop plate. The first grip member includes a cap engaging edge which at least partially corresponds to an outside surface of the cap. The second grip member is positioned in opposed relationship to the first grip member and has a grip surface positioned a predetermined distance from the cap engaging edge of the first grip member. The distance between the grip surface of the second grip member and the cap engaging edge of the first grip member is approximately equal to a diameter of the lower section of the cap and is less than the diameter of the upper section of the cap.

10 Claims, 6 Drawing Sheets

CAP REMOVER

BACKGROUND OF THE INVENTION

1. Field of the Invention

The present invention relates generally to a device for removing caps from empty bottles and, more specifically, to a device that removes bottle caps from water bottles so the water bottle can be cleaned and re-used.

2. Description of the Related Art

It is commonly known and practiced within the bottled water industry, and others, that detachable, plastic bottle caps are mounted on the neck of a variety of sizes and shapes of bottles. Such bottle caps seal the bottle and the contents inside prior to the installation of the bottle on a dispenser. In the water industry such use involves the inversion of the bottle and placement of it onto a drinking water dispensing system. In the past, a cap on the bottle would be removed prior to use through the use of an attached pull tab and a scoreline.

Recent developments in the water bottle/bottle cap industry include a cap which has a central tube section that is capable of receiving a specialized water dispensing probe from a water dispensing system. This tube section has an inner seal which prevents the water from escaping the bottle until such dispensing probe is inserted. With this type of arrangement, the bottle cap itself need not be removed prior to placement of the bottle onto a water dispensing system. Indeed, at no time during the bottle's use by a consumer does the bottle cap ever have to be removed. As a result, water bottles which are being returned with these types of bottle caps still securely affixed thereon are cleaner and can be more easily re-used.

Obviously, the presence of these attached bottle caps forces bottlers and recycling plants to perform an additional labor task before the corresponding bottles may be refilled. One way of addressing this problem is to employ additional laborers to peel and/or pry off the bottle caps in a manual fashion. Such a method, however can be both costly and inefficient, particularly in comparison to the highly automated methods of handling other tasks known within the bottling industry today. Accordingly, highly automated bottle cap removal systems have been developed for removing bottle caps from bottles moving along a conveyor-type system. For example, U.S. Pat. No. 5,826,409 discloses a bottle cap removing system which is easily adapted to a conveyor system of either 5-gallon or 3-gallon bottle movement within a bottling or recycling facility. This system automatically determines which, if any, bottles have attached bottle caps and automatically removes such bottle caps in an efficient and cost-effective manner.

While the system disclosed in U.S. Pat. No. 5,826,409 has proven to be highly efficient and cost effective in high volume bottle recycling and refilling plants, there are certain small volume bottlers which do not wish to allocate their capital expenditures to highly automated cap removing systems. Ideally, the bottle cap removing needs of these small volume bottlers could be efficiently achieved by a cap removal system that allows the individuals who collect empty water bottles, such as truckers, to remove bottle caps at the point of collection.

In light of the additional costs associated with the process of removing bottle caps from bottles by hand at a bottle recycling facility, what is needed in this field of art is a bottle cap remover which can be easily and inexpensively adapted for use within a standard bottling plant, or within in a truck which is used to transport used water bottles.

The advantages of the instant invention described above with reference to the bottled water industry are also applicable to other industries involved in the distribution of liquids, such as edible oils and liquid chemicals, and may also have application in industries involved in the distribution of flowable powders.

SUMMARY OF THE INVENTION

The present invention makes a contribution to the cap remover art by providing a bottle cap remover that may be used to separate a cap from a bottle wherein the cap has an upper section and a lower section and at least a portion of the upper section of the cap protrudes radially outwardly beyond the lower section of the cap. A cap remover in accordance with the present invention includes a first grip member and a second grip member. The first grip member is rigidly mounted to a stop plate in a position where the first grip member is spaced from the stop plate to define a gap between the first grip member and the stop plate. The first grip member includes a cap engaging edge which at least partially corresponds to an outside surface of the cap. The second grip member is positioned in opposed relationship to the first grip member and has a grip surface positioned a predetermined distance from the cap engaging edge of the first grip member. The distance between the grip surface of the second grip member and the cap engaging edge of the first grip member is approximately equal to a diameter of the lower section of the cap and is less than the diameter of the upper section of the cap.

Preferably, the stop plate and the first grip member are moveable together from an open position to a gripping position, and the first grip member and the second grip member are spaced from one another so as to engage opposite sides of the cap when the stop plate and the first grip member are in the gripping position. The first grip member may have at least two points of contact for receiving the lower section of the cap, and in this arrangement, the second grip member can urge the cap into engagement with the points of contact below the upper section of the cap as the stop plate and the first grip member are moved from the open position to the gripping position.

The first grip member may have a curved edge for receiving the lower section of the cap while a portion of the upper section of the cap is disposed in the gap between the first grip member and the stop plate. In another version of the invention, the first grip member and the stop plate are biased into the open position.

The stop plate may be hinged to a base plate and pivot between the open and gripping positions. In addition, the stop plate may include a stop pin which abuts the base plate when the first grip member and the stop plate are in the gripping position. The cap remover may also include a spring assembly which comprises a spring mounted between the stop plate and the base plate, a limiting bolt fixed to the stop plate and extending through the base plate for supporting the spring, and a head on the limiting bolt for engaging the base plate when the stop plate and the first grip member are in the open position.

Preferably, the second grip member of the bottle cap remover has a guide surface that is sloped so as to define points of varying distance from the cap engaging edge of the first engaging member. In this arrangement, the cap is gripped with gradually increasing gripping forces as a bottle carrying the cap is rotated about the cap engaging edge.

Therefore, it is an object of the present invention to provide an extremely quick means of removing bottle caps from bottles.

Moreover, an additional important object of this invention is to provide a device for removing bottle caps from bottles whereby no damage will be imparted to the bottle.

An overall object of the present invention is to provide a device for removing bottle caps from bottles which requires a minimal amount of effort to use.

Further objects and advantages of this invention will become apparent to those of ordinary skill in the pertinent art upon review of the following detailed description and accompanying drawings.

BRIEF DESCRIPTION OF THE DRAWINGS

For a more complete understanding of this invention, reference should now be made to the embodiment described below and illustrated in greater detail in the accompanying drawings wherein.

The figures are not necessarily to scale and the embodiments are sometimes illustrated by phantom lines and diagrammatic representations. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE INVENTION

Figure 1:
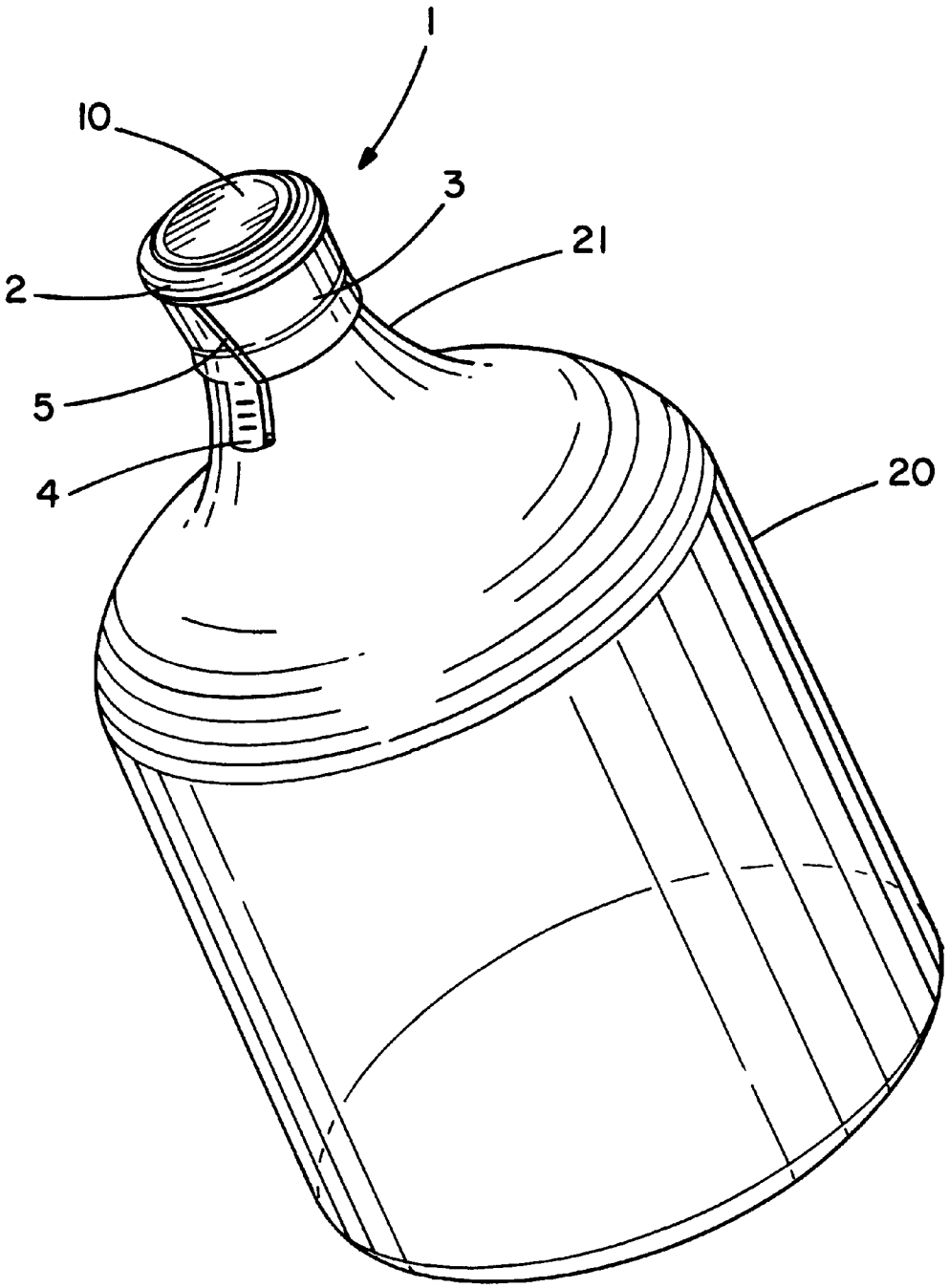
PRIOR ART FIG. 1
FIG. 1 is a perspective view of a bottle cap in its sealed position upon the neck of a standard five gallon bottle.
Figure 2:
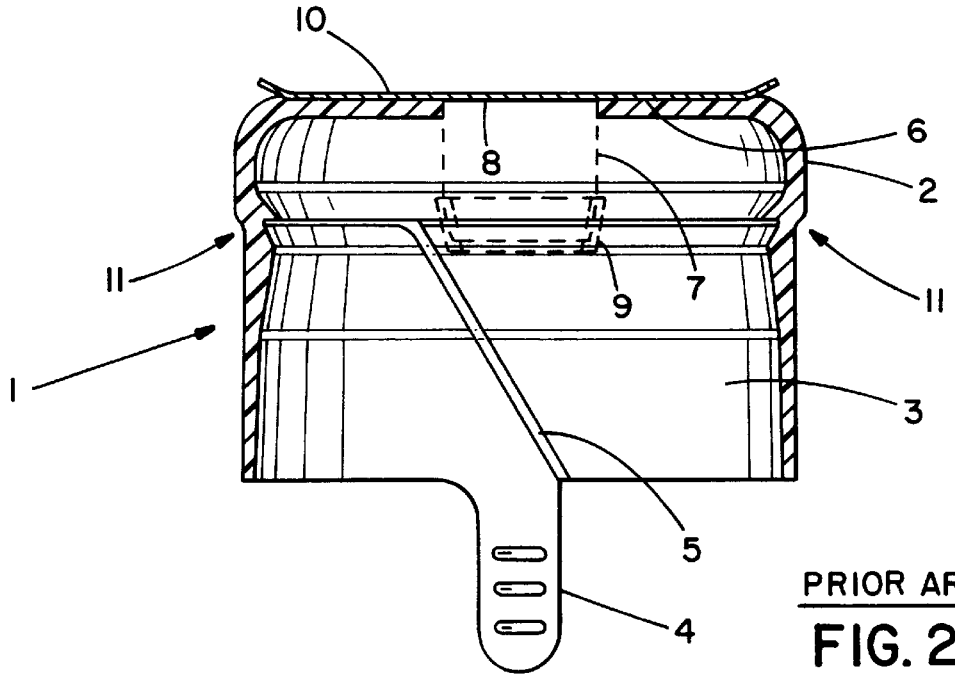
PRIOR ART FIG. 2
FIG. 2 is a side, cross-sectional view of the bottle cap shown in FIG. 1.

Turning first to FIGS. 1 and 2, there is shown a bottle cap 1 displayed in its sealed position upon the neck 21 of a standard five gallon bottle 20.

The openable bottle cap 1 shown includes an upper or snap-on ring section 2, a lower section or skirt 3, a pull tab 4 and a scoreline 5. In other versions of the bottle cap 1, the pull tab 4 and scoreline 5 may be omitted. Normal application of the bottle cap 1 requires that the snap-on ring section 2 and skirt 3 be securely affixed to the neck 21 of the bottle 20.

Figure 3:
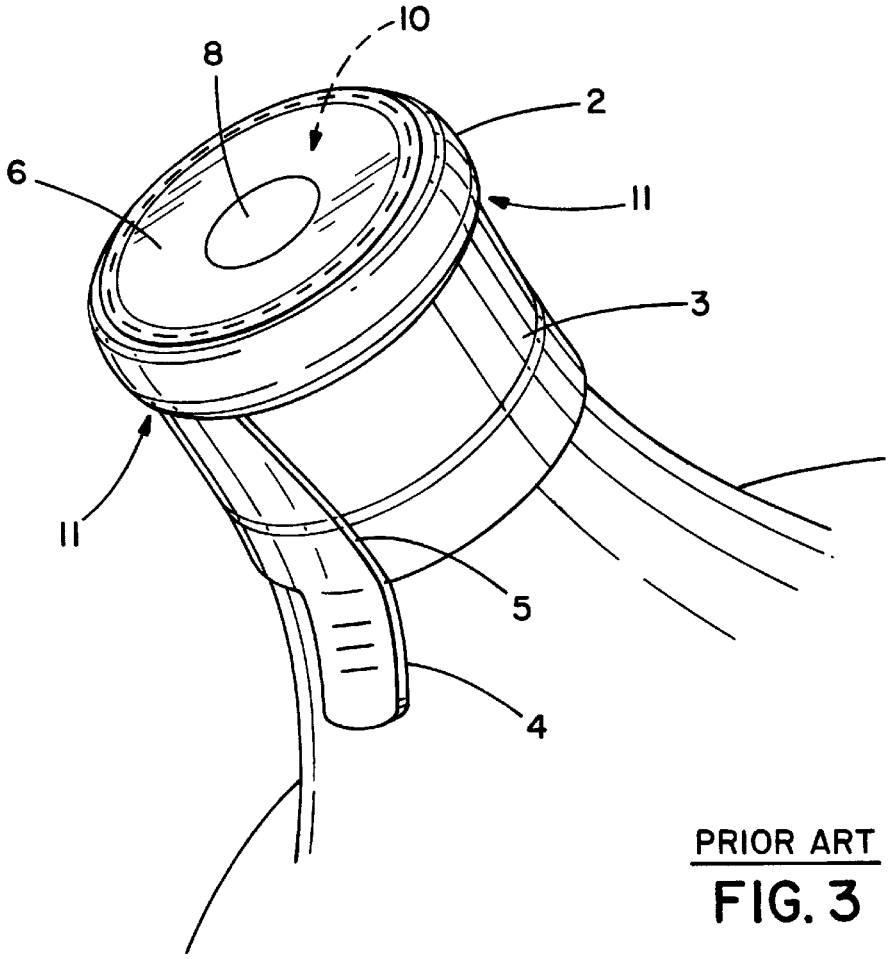
PRIOR ART FIG. 3
FIG. 3 is a another perspective view of a bottle cap in its sealed position upon the neck of a standard five gallon bottle having a tamper evident label shown in phantom lines.

FIGS. 1–3 also show a tamper-evident label 10 placed upon the upper face 6 of the bottle cap 1. In its sealed position, the tamper-evident label 10 protects a dispensing outlet 8 of the bottle cap 1 from contaminants.

Referring now to FIG. 2, a cross-sectional view of the bottle cap 1 is illustrated. This figure shows not only the pull tab 4 and the scoreline 5, but also the structural outline of both the snap-on ring section 2 and the skirt 3. It can be seen that the snap-on ring section 2 includes a lower lip 11 which extends around the lower circumference of the snap-on ring section 2. With this configuration of the lip 11 on the snap-on ring section 2, the bottle cap 1 has at least two different outside diameters, i.e., at least one diameter at the snap-on ring section 2 and at least one diameter below the lip 11 of the snap-on ring section 2. The bottle cap 1 also has a relatively planar upper face 6. Formed integrally within this upper face 6 is the central dispensing tube 7. The central dispensing tube 7 has an outlet 8 through which the liquid may be dispensed. For the purpose of sealing the bottle cap 1 and, more specifically, the central dispensing tube 7 to prevent liquid from being discharged before installation, a dispensing tube cap 9 is attached to the innermost end of the central dispensing tube 7. The bottle cap 1 is of the type in which the central tube 7 is capable of sealingly engaging a dispensing probe which is part of a dispensing system. The dispensing probe (not shown) passes through the outlet 8 of the central dispensing tube 7, and a groove on the probe connects to the dispensing tube cap 9. When the probe is far enough inside the container, a hole in the side of the probe allows the liquid to flow freely from the bottle.

Figure 4:
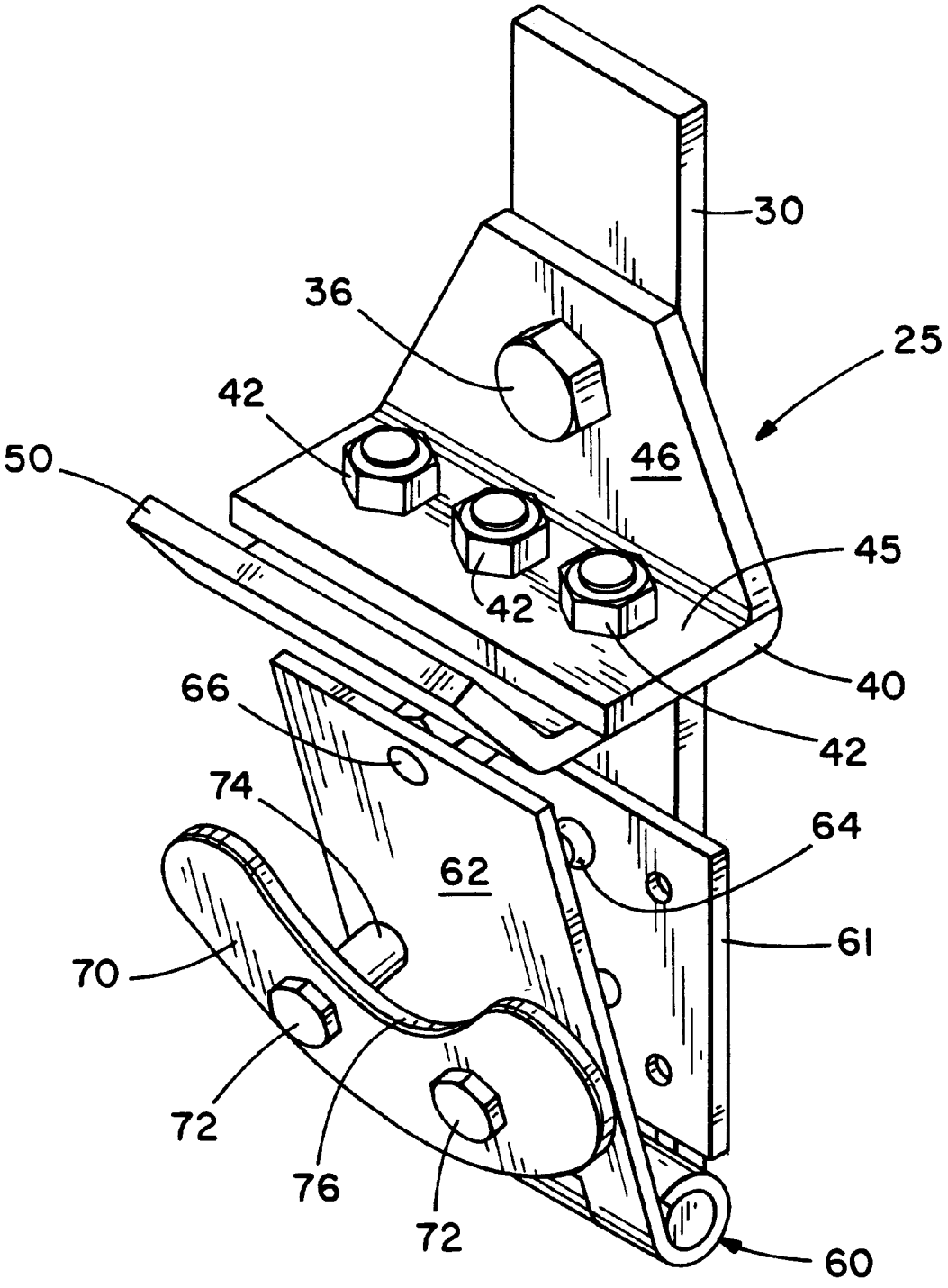
FIG. 4 is a front perspective view of one version of a cap remover in accordance with the present invention.
Figure 5:
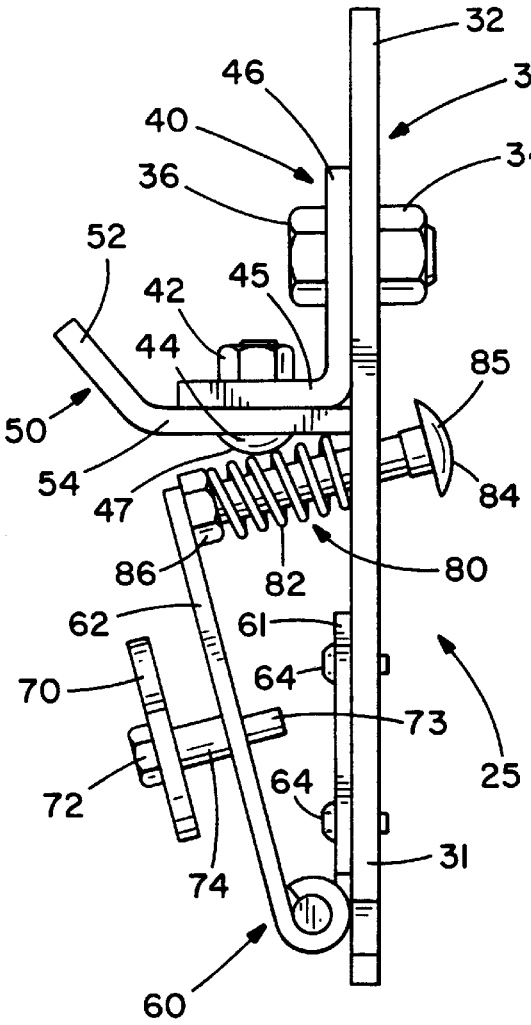
FIG. 5 is a side view of the cap remover shown in FIG. 4.
Figure 6:
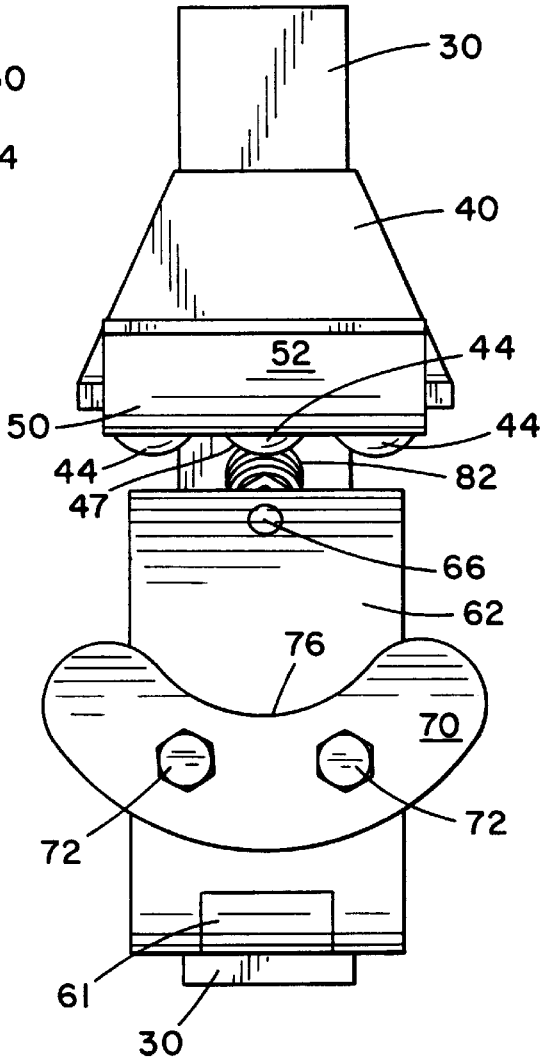
FIG. 6 is a front view of the cap remover shown in FIG. 4.

Turning now to FIGS. 4–6, there is shown one version of the cap remover 25 of the present invention. The cap remover 25 as shown in FIGS. 4–6 includes a base plate 30, an L-shaped bracket 40, an angled bracket 50, a hinge 60, a yoke 70, and a spring assembly 80. These and the other components of the cap remover 25 are preferably fabricated from stainless steel, aluminum or other suitable corrosion resistant materials.

The base plate 30 of the cap remover 25 provides a sturdy support upon which other components of the cap remover 25 may be mounted or secured. The base plate 30 is configured such that the cap remover 25 may be easily mounted on a vertical surface such as the wall of a bottle transport vehicle or other vertical supports in a bottle recycling facility.

In the version of the cap remover 25 shown, the L-shaped bracket 40 has a vertical section 46 and a horizontal section 45. The vertical section 46 of the L-shaped bracket 40 is secured to an upper portion 32 of the base plate 30. In the version of the cap remover 25 shown, after the L-shaped bracket 40 is secured to the base plate 30, the horizontal section 45 of the L-shaped bracket 40 extends outwardly at a generally right angle to the base plate 30.

The angled bracket 50 of the cap remover 25 shown includes a horizontal section 54 and an angled section 52. The horizontal section 54 of the angled bracket 50 is secured to the horizontal section 45 of the L-shaped bracket 40 by three round head bolts 44 and three nuts 42. Of course, other suitable securing means such as welding and riveting are available. The middle bolt of the three round head bolts 44 acts as a second grip member during operation of the cap remover and includes an outer surface 47 which acts as a grip surface during operation of the cap remover 25. After the angled bracket 50 is secured to the L-shaped bracket 40, the horizontal section 54 of the angled bracket 50 extends outwardly at a generally right angle to the base plate 30, and the angled section 52 of the angled bracket 50 slants upward from the horizontal section 54 of the angled bracket 50.

The hinge 60 of the cap remover 25 shown includes a vertical mounting section 61 and a stop plate or pivoting section 62. The mounting section 61 of the hinge 60 is secured to the lower portion 31 of the base plate 30 by threaded bolts 64 which engage threads in tapped holes which are formed in the lower portion 31 of the base plate 30. Of course, other suitable means for securing the mounting section 61 of the hinge 60 to the lower portion 31 of the base plate 30 are available such as welding or riveting.

The yoke 70 of the cap remover 25 shown is generally crescent shaped and acts as a first grip member during operation of the cap remover 25. The yoke 70 is mounted on the pivoting section 62 of the hinge 60 by way of threaded bolts 72 which engage threads in tapped holes in the pivoting section 62 of the hinge 60. During assembly of the cap remover 25, hollow cylindrical spacers or sleeves 74 are placed over the threaded bolts 72 and between the yoke 70 and pivoting section 62 of the hinge 60 so that a gap or space between the yoke 70 and pivoting section 61 of the hinge 60 is created when the yoke 70 is assembled to the hinge 60. It can be readily appreciated that different sized spacer 74 can be used in order to vary the gap or spacing between the yoke 74 and pivoting section 62 of the hinge 60. The length of the threaded bolts 72 selected to mount the yoke 70 to the hinge 60 can also be varied in order to create a portion 73 of the threaded bolt 72 which extends beyond the pivoting section 62 of the hinge 60 when the yoke 70 and hinge 60 are secured together. After the yoke 70 is assembled to the hinge 60, a generally curved cap engaging edge 76 of the yoke is placed in generally facing relationship with the angled bracket 50.

The spring assembly 80 of the cap remover 25 shown includes a compression spring 82, a threaded limiting bolt 84 and a nut 86. The spring assembly 80 is installed in the cap remover 25 as follows. First, a tapped hole 66 having threads is formed in the upper end of the pivoting section 62 of the hinge 60. The threaded bolt 84 is then inserted into a hole formed in the middle section of the base plate 30. The compression spring 82 is placed around the shaft of the bolt 84 and the bolt 84 is threaded through the nut 86 and into the tapped hole 66 in the pivoting section 62 of the hinge 60. The nut 86 is adjusted so that it fits snugly against the pivoting section 62 of the hinge 60 thereby providing a seat for the end of the compression spring 82. The compression spring 82 is selected with a free length such that the compression spring 82 biases the pivoting section 62 of the hinge 60 open to a position where the head 85 of the threaded limiting bolt 84 rests against an outer surface of the base plate 30.

In an alternative embodiment, the nut 86 may be omitted from the spring assembly 80 and the compression spring 82 may be seated directly on the pivoting section 62 of the hinge 60. In still another alternative embodiment, the nut 86 of the spring assembly 80 may be secured directly to the pivoting section 62 of the hinge 60 and the tapped hole 66 may be omitted from the pivoting section 62 of the hinge 60. In this version of the invention, it can be appreciated that the threaded bolt 84 will not extend into the pivoting section 62 of the hinge 60 when the spring assembly 80 is installed in the cap remover 25.

Figure 7:
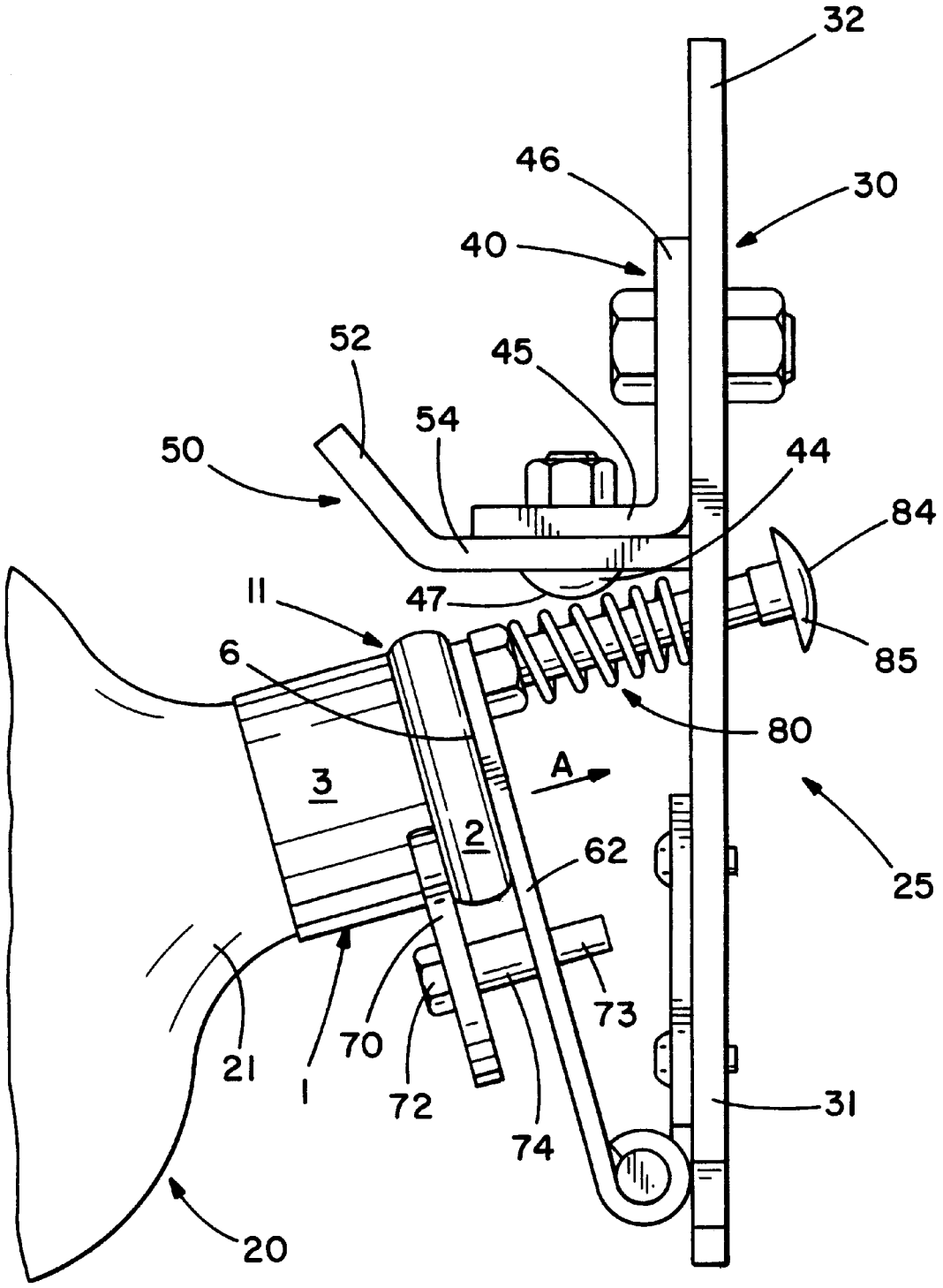
FIG. 7 is a side view of the cap remover shown in FIG. 4 with a bottle positioned in the cap remover in a first stage of the cap removal process.
Figure 8:
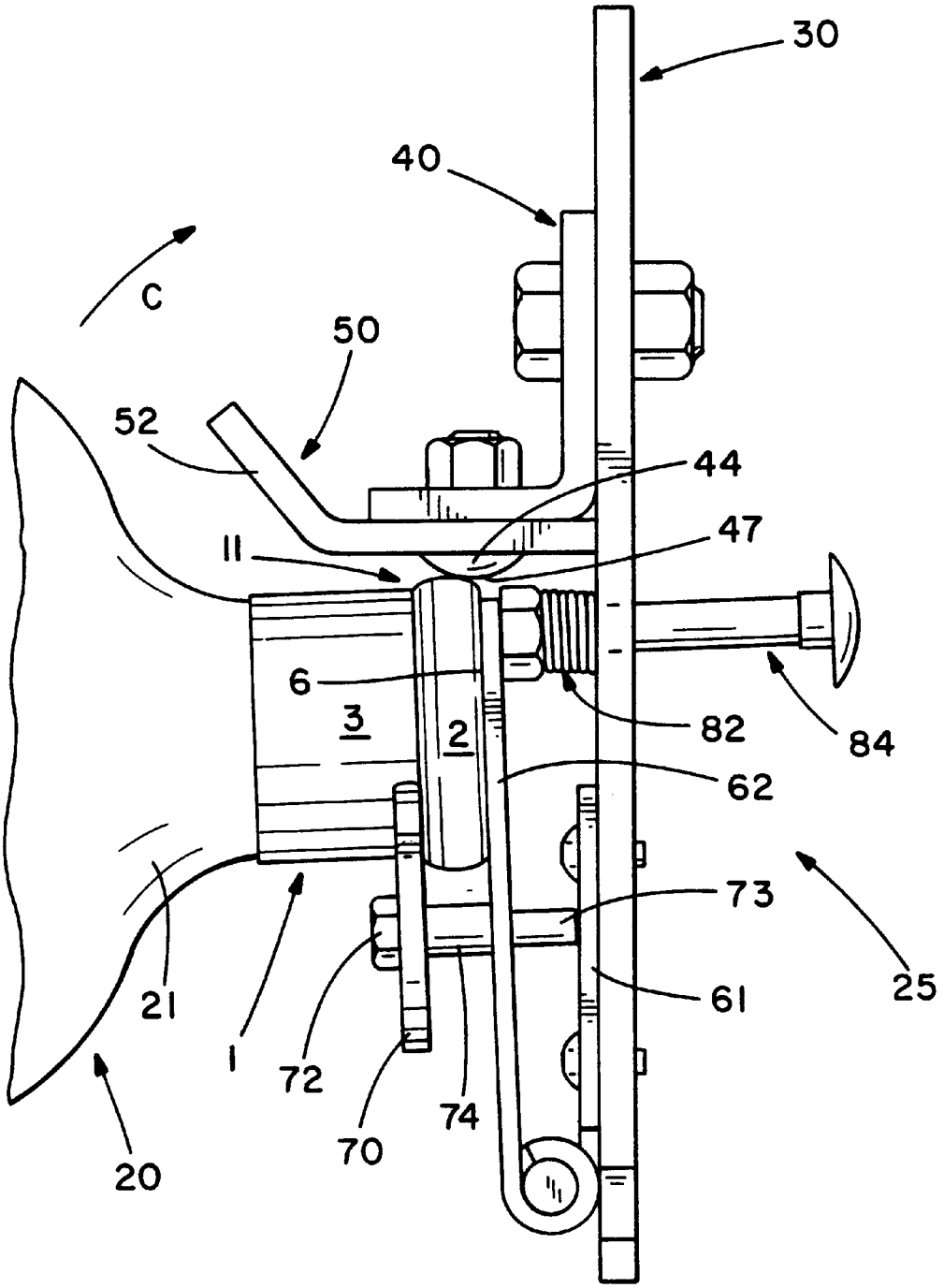
FIG. 8 is a side view of the cap remover shown in FIG. 4 with a bottle positioned in the cap remover in a second stage of the cap removal process.

Having described the construction of a version of a cap remover 25 in accordance with the invention, the operation of the cap remover 25 is shown in FIGS. 7 and 8. Referring first to FIG. 7, an initial stage in the operation of the cap remover 25 is shown. A bottle 20, as shown in FIGS. 1–3 and described above, having a bottle cap 1 installed on its neck 21 is shown in engagement with the yoke 70 of the cap remover 25. In operation, the user of the cap remover 25 grasps a bottle 20 and places a section of the skirt 3 of the bottle cap 1 which lies below the lip 11 of the snap-on ring section 2 against the cap engaging edge 76 of the yoke 70 (the cap engaging edge 76 of the yoke being shown in FIGS. 4 and 6). The angled section 52 of the angled bracket 50 may act as a guiding surface which assists the user in getting the bottle cap 1 into engagement with the cap engaging edge 76 of the yoke 70. When the bottle cap 1 is placed in engagement with the yoke 70, the upper face 6 of the bottle cap 1 will typically abut the pivoting section 62 of the hinge 60.

With the bottle cap 1 in engagement with the yoke 70 and the pivoting section 62 of the hinge 60, the user then moves the bottle 20 in direction A toward the base plate 30. Movement of the pivoting section 62 of the hinge 60 continues until the portion 73 of the threaded bolt 72 which extends beyond the pivoting section 62 of the hinge 60 acts as a stop pin by contacting the mounting section 61 of the hinge 60 as shown in FIG. 8. When the cap remover 25 and bottle 20 are in the position shown in FIG. 8, the snap-on ring section 2 of the bottle cap 1 engages the outer surface 47 of the middle bolt of the three round head bolts 44 thereby gripping the bottle cap 1. In this position, the distance between the outer surface 47 of the middle bolt of the three bolts 44 and the cap engaging edge 76 of the yoke 70 is approximately equal to a diameter of the lower section or skirt 3 of the bottle cap 1, and the distance is less than a diameter of the upper or snap-on ring section 2 of the bottle cap 1. After the bottle 20 has been placed in the position shown in FIG. 8, the user moves the bottle 20 in the direction C shown in FIG. 8 to remove the bottle cap 1 by way of the gripping action of the yoke 70. Advantageously, any debris or water remaining in the bottle 20 is also removed from the bottle 20 as a result of the bottle 20 being in an inverted position.

The cap remover shown in the drawings is equipped with a spring-based stop plate 62. The action of the spring 82 serves to tilt the stop plate from the position shown in FIG. 8 (i.e., the gripping position) back to a position even more tilted than the position shown in FIG. 5 (i.e., the open position). The spring bias applied by the spring 82 to the stop plate 62 causes the cap to be ejected from the device automatically, so that the device can be ready for another cap removal operation with the operator having to remove the cap from the remover. In a bottling facility, the cap remover of the present invention would typically be located near the machine used to wash bottles for re-use. A bucket placed beneath the remover may be used to receive the bottle caps, which are easily ground-up so that the plastic of the cap can be recycled.

A bottler also has the option of having a delivery person perform the cap removing operation as part of his or her duties. The cap remover of the present invention could be conveniently mounted to the side or just inside the area of a delivery truck used to deliver bottles to and retrieve bottles from customers' facilities. As empty bottles are placed on or removed from the delivery truck, the driver could perform the cap removal operation.

It should be noted that the convenience of the ejection of the cap from the remover may not be essential. For example, a remover with all fixed components arranged essentially in the position shown in FIG. 8 would allow the quick removal of caps from bottles. The remover could be oriented such that gravity would tend to dislodge the cap from the remover.

It should also be noted that while the remover of the present invention is shown as being oriented in such a way that an upward motion of the bottle separates the cap from the bottle neck, the orientation of the remover could be otherwise. For example, it could be rotated 180° from the orientation shown so that a downward motion of the bottle causes separation of the cap from the bottle neck.

While the present invention has been illustrated in some detail according to the preferred embodiment shown in the foregoing drawing and description, it will become apparent to those skilled in the pertinent art that variations and equivalents may be made within the spirit and scope of that which has been expressly disclosed. Accordingly, it is intended that the scope of the invention be limited solely by the scope of the hereafter appended claims and not by an specific wording in the foregoing description.

What is claimed is:

1. A bottle cap remover for separating a cap from a bottle, said cap having an upper section and a lower section, at least a portion of said upper section protruding radially outwardly beyond said lower section, said remover comprising:

a first grip member rigidly mounted to a stop plate, said first grip member being spaced from said stop plate and defining a gap between said first grip member and said stop plate, said first grip member defining a cap engaging edge at least partially corresponding to an outside surface of said cap; and a second grip member opposing said first grip member and having a grip surface disposed a distance from said cap engaging edge, said distance being approximately equal to a diameter of said lower section of said cap, and said distance being less than a diameter of said upper section of said cap, at least one of said first grip member and said stop plate being moveable relative to the other to form an open position and being biased into said open position.

2. A bottle cap remover in accordance with claim 1 wherein said stop plate and said first grip member are moveable together from said open position to a gripping position, said first grip member and said second grip member being spaced from one another so as to engage opposite sides of a cap when said stop plate and said first grip member are in said gripping position.

3. A bottle cap remover in accordance with claim 2 wherein said first grip member has at least two points of contact for receiving said lower section of said cap, said second grip member urging said cap into engagement with said points of contact below said upper section as said stop plate and said first grip member are moved from said open position to said gripping position.

4. A bottle cap remover in accordance with claim 2 wherein said stop plate is hinged to a base and defining a pivot line about which said stop plate pivots as said stop plate moves between said open and gripping positions, said stop plate having a stop pin which abuts said base when said first grip member and said stop plate are in said gripping position.

5. A bottle cap remover in accordance with claim 4 wherein a spring is mounted between said stop plate and said base, said spring being supported by a limiting bolt, said bolt being fixed to said stop plate and extending through said base, a head on said bolt engaging said base when said stop plate and said first grip member are in said open position.

6. A bottle cap remover in accordance with claim 1 wherein said first grip member has a curved edge for receiving said lower section of said cap while a portion of said upper section of said cap is disposed in said gap.

7. A bottle cap remover for separating a cap from a bottle, said cap having an upper section and a lower section, at least a portion of said upper section protruding radially outwardly beyond said lower section, said remover comprising:

a first grip member rigidly mounted to a stop plate, said first grip member being spaced from said stop plate and defining a gap between said first grip member and said stop plate, said first grip member defining a cap engaging edge at least partially corresponding to an outside surface of said cap; and a second grip member opposing said first grip member and having a grip surface disposed a distance from said cap engaging edge, said distance being approximately equal to a diameter of said lower section of said cap, and said distance being, less than a diameter of said upper section of said cap said second grip member having a guide surface, said guide surface being sloped so as to define points of varying distance from said cap engaging edge, whereby said cap is gripped with gradually increasing gripping forces as a bottle carrying said cap is rotated about said cap engaging edge.

8. A bottle cap remover in accordance with claim 7 wherein said stop plate and said first grip member are moveable together from an open position to a gripping position, said first grip member and said second grip member being spaced from one another so as to engage opposite sides of a cap when said stop plate and said first grip member are in said gripping position.

9. A bottle cap remover in accordance with claim 8 wherein said first grip member has at least two points of contact for receiving said lower section of said cap, said second grip member urging said cap into engagement with said points of contact below said upper section as said stop plate and said first grip member are moved from said open position to said gripping position.

10. A bottle cap remover in accordance with claims wherein said first grip member has a curved edge for receiving said lower section of said cap while a portion of said upper section of said cap is disposed in said gap.

* * * * *